United States Patent [19]

Geary

[11] 4,334,623

[45] Jun. 15, 1982

[54] RACK FOR THE DISPLAY AND STORAGE OF STEMMED DRINKING GLASSES

[76] Inventor: Frank Geary, 96 Moss La., Platt Bridge, Near Wigan, Lancashire, England

[21] Appl. No.: 72,321

[22] Filed: Sep. 4, 1979

[51] Int. Cl.[3] ..... A47G 29/00

[52] U.S. Cl. ..... 211/71; 211/78; 211/131

[58] Field of Search ..... 211/78, 39, 95, 88, 211/71, 115, 163, 131; 248/126, 311.2

[56] References Cited

U.S. PATENT DOCUMENTS

| | | | |
|---|---|---|---|
| 1,242,017 | 10/1917 | Mendelsohn | 211/39 |
| 1,247,195 | 11/1917 | Willett | 211/78 |
| 1,430,748 | 10/1922 | Nolte | 211/78 |
| 1,809,195 | 6/1931 | Evans | 211/39 |
| 1,947,325 | 2/1934 | Bailey | 211/95 X |
| 3,472,389 | 10/1969 | Lowe | 211/60 R |
| 3,491,893 | 1/1970 | Morris | 211/71 UX |
| 4,026,417 | 5/1977 | Streim | 211/131 |

FOREIGN PATENT DOCUMENTS

| | | | |
|---|---|---|---|
| 85794 | 3/1896 | Fed. Rep. of Germany | 211/78 |
| 1086715 | 2/1955 | France | 248/126 |
| 328181 | 4/1930 | United Kingdom | 211/39 |

*Primary Examiner*—J. Franklin Foss

*Attorney, Agent, or Firm*—Oblon, Fisher, Spivak, McClelland & Maier

[57] ABSTRACT

A rack for storing and for displaying stemmed drinking glasses especially for use in bars and restaurants has glass support means defining slots into which the glasses can be inserted, bowl uppermost, by their stems and the bowl seated in the slot (or in a circular enlargement of the slot) and a cover that is spaced over the support member by an amount sufficient to accommodate the glasses yet effectively to restrict ingress of dust and/or smoke laden air.

9 Claims, 5 Drawing Figures

RACK FOR THE DISPLAY AND STORAGE OF STEMMED DRINKING GLASSES

This invention relates to racks for the display and/or storage of stemmed drinking glasses, and is especially though not exclusively intended for use in bars and restaurants, which have to meet stringent standards of hygiene. Methods for storing stemmed drinking glasses in common use are not entirely satisfactory. The practice is widespread of setting glasses rim down on a shelf which may not itself be clean. The alternative method—standing the glasses on their feet on an open shelf—means that the bowls of the glasses are open to ingress of dust and tobacco smoke (such being a feature of bars).

The invention has for one of its objects to provide an improved means of storing and/or displaying stemmed drinking glasses that is hygienic in that the rims of the glasses do not come into contact with any surface that might not be clean. Another object is to store and/or display glasses conveniently within reach and not behind any kind of enclosure, yet effectively to restrict ingress of dust and/or smoke laden air to the bowls. Another object is to accommodate different sizes and styles of stemmed drinking glass and display and store them substantially equally effectively and hygienically.

The invention comprises a rack for the display and storage of stemmed drinking glasses—such as wine and spirit glasses—characterised by glass support means adapted to be mounted substantially horizontally and defining slots adapted to accept the stems of glasses and to form a seating for the bowls of glasses inserted by their stems with their bowls uppermost and their feet beneath the plate, and a cover arranged over said support means and spaced therefrom by an amount sufficient to accommodate the bowls of stemmed drinking glasses inserted into the said slots.

It is found that the principal difference between sizes and styles of stemmed drinking glasses is in the lengths of their stems. A given spacing of the cover from the support means will therefore accommodate a wide range of glass styles and sizes without leaving too much space between the cover and the rim of any one glass, so that the cover is effective to restrict ingress of dust and/or smoke laden air for a wide variety of stemmed glasses.

Said support means may comprise a plate slotted in at least one edge and may be circular in plan and define radial slots open to its periphery.

Said support means may be mounted for rotation about a vertical axis, and the rack may comprise a spindle adapted for vertical mounting, the said plate resting on a seating flange on or secured to said spindle and the said cover being seated on a spacing collar surrounding said spindle and seated in turn on said plate. Said spindle may be adapted for attachment to a wall or ceiling so that the plate can be set at or just about head height. Instead, however, the rack may be adapted for table or counter top mounting by comprising a base adapted, as by having screw holes, to be secured thereon.

An alternative arrangement would be linear shelf unit for attachment to walls or table or counter tops, or even for free-standing.

The slots may be better adapted to seat glasses by having circular enlargements.

Two or more slotted plates and associated covers may be mounted one above the other in two- or multi-tier assembly.

Stemmed drinking glass display and/or storage racks according to the invention will now be described with reference to the accompanying drawings in which.

Figure 1:
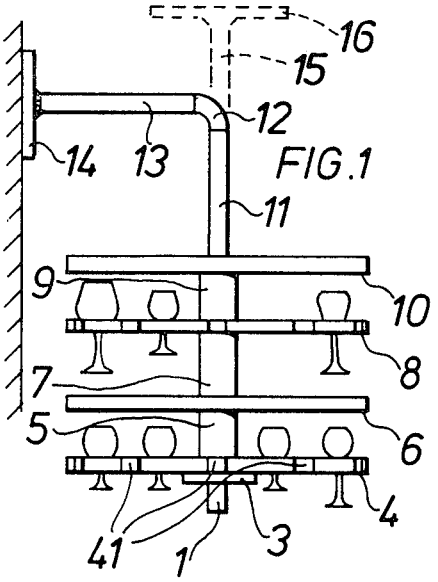
FIG. 1 is a side elevation of one embodiment.

FIG. 1 to 4 show racks for the display and/or storage of stemmed drinking glasses comprising a plate 4, 8 in the form of a circular disc and adapted to be mounted horizontally and having radial slots 41 opening to its circumference. The slots 41 (FIG. 4) are adapted to accept the stems of wine or spirit glasses and to form a seating for the bowls of such glasses inserted by their stems into the slots 41 with their bowls uppermost and their feet beneath the plate 4, 8. Over the plates 4, 8 are arranged dust covers 6, 10 spaced from the plates 4, 8 by an amount sufficient to accommodate the bowls of stemmed drinking glasses inserted into the said slots.

The plates 4, 8 are mounted for rotation about a vertical axis and the racks comprise spindles 11 adapted for vertical mounting, the said plates 4 resting on a seating flange 3 on or secured to said spindle 11 and the covers 6 being seated on spacing collars 5 seated on the said plates 4. The drawings show two tier arrangements in which the upper slotted plates 8 are seated on further spacing collars 7 on the spindles 11, and their associated covers 10 are in turn seated on spacing collars 9.

Figure 3:
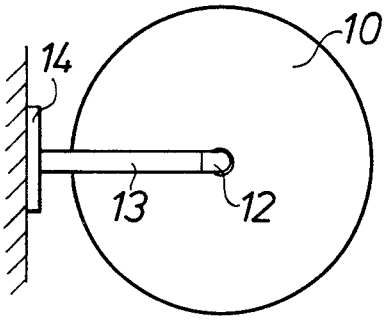
FIG. 3 is a plan view of the embodiment shown in FIG. 1.

FIGS. 1 and 3 show the spindle 11 adapted for attachment to a wall, by having a right-angled joint 12 and an extension 13 with a plate 14 provided with holes (not shown) for screws.

FIG. 1 shows in broken lines an alternative arrangement in which the spindle 11 has instead an upwards extension 15 to a ceiling fixing plate 16.

The lower end of the spindle 11 is closed off with a plug 1.

Figure 2:
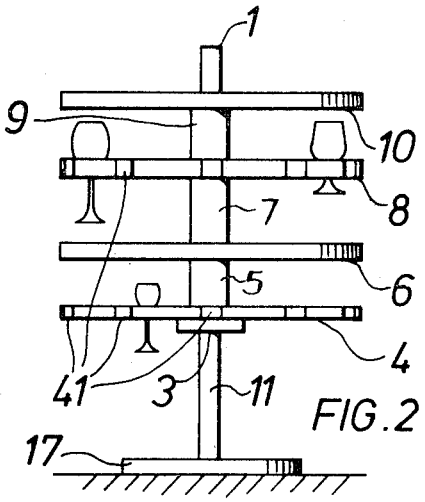
FIG. 2 is a side elevation of another embodiment.

FIG. 2 shows a rack adapted to be fixed to a table or bar counter top by having a fixing plate 17 at the lower end of the spindle 11. In this case the plug 1 goes at the top of the spindle 11.

Figure 4:
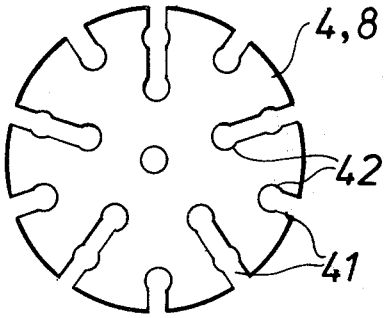
FIG. 4 is a plan view of a slotted plate of either embodiment.

FIG. 4 shows how the slots 41 are adapted to seat glasses by having circular enlargements 42. The enlargements 42 are shown only at the outside end of each slot, though the longer slots might accommodate up to three glasses, and the shorter slots one or two.

The racks are preferably readily taken to pieces for cleaning and this is facilitated by having the seating flange 3 secured by a bolt and wing nut.

Suitable materials for constructing the racks would be, for example, 1 inch outside diameter chrome plated tube for the spindle 11 and extensions 13, 15 and 5 mm plastic plate for the discs 4, 8 and covers 6, 10. The discs 4, 8 and covers 6, 10 can be any convenient size, but 18" diameter is a convenient size. Such a rack, provided with 10 slots as shown could accommodate up to twenty five glasses on each tier. The longer slots can $6\frac{1}{2}$" long, and the shorter slots $4\frac{1}{2}$" long. A suitable width for the slots is $1\frac{1}{4}$", and the enlargements 42 may be $1\frac{1}{2}$" in diameter and $\frac{1}{2}$" in from the edge of the disc.

The spacing collars 5, 7 and 9 may be the same plastic material as the discs 4, 8 and covers 6, 10, and are conveniently 4½" long by 2½" diameter with 1" bore able to revolve freely on the spindle 11.

The racks comprise an effective and attractive storage arrangement serving to avoid contamination of glasses by falling dust as well as by rising smoke, and keeping the rims of the glasses out of contact with surfaces that might be similarly contaminated.

Figure 5:
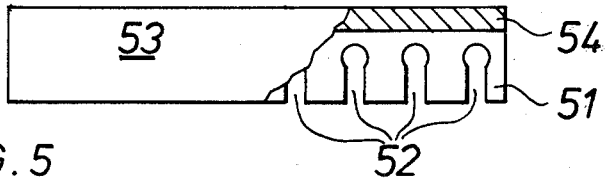
FIG. 5 is a plan view of a third embodiment.

FIG. 5 shows a linear shelving arrangment adapted to be secured to a wall and comprising glass support means 5, comprising an elongate shelf-like plate but having slots 52 in the front edge for the stems of glasses, and a cover 53 suitably spaced from the support means 51 as already described. The support means 51 and cover 53 are connected by a distance piece 54.

I claim:

1. A rack for the display and storage of stemmed drinking glasses comprising at least one glass support means adapted to be mounted substantially horizontally and defining slots opening to the periphery thereof and adapted to accept the stems of glasses and having at least one circular enlargement to form a seating for the bowls of glasses inserted by their stems into the slots with their bowls uppermost and their feet beneath the plate, and a cover arranged over each said support means and spaced therefrom by an amount sufficient to accomodate the bowls of stemmed drinking glasses in said slots during insertion, storage and removal of said drinking glasses, whereby said glasses can be horizontally inserted into and removed from said rack, and the bowls thereof are protected by said cover; and securement means connecting said support means and cover, said securement means being adapted to fix said rack to a portion of a room.

2. A rack according to claim 1, characterised in that said support means comprise a plate slotted in at least one edge.

3. A rack according to claim 1 wherein said support means are circular in plan and define radial slots.

4. A rack according to claim 3 wherein said support means are mounted for rotation about a vertical axis.

5. A rack according to claim 4 further comprising a spindle adapted for vertical mounting, an abutment, and a spacer surrounding said spindle, said support means resting on said abutment, and a spacer surrounding said spindle, said cover resting on said spacer.

6. A rack according to claim 5 wherein said securement means comprise a spindle adapted for attachment to a wall or ceiling so that said support means can be at about head height.

7. A rack according to claim 1 wherein said securement means comprise a base adapted to be secured to a table or a counter top.

8. A rack according to claim 1 wherein said support means define slots having at least one circular enlargement forming a seating for a glass.

9. A rack according to claim 1 comprising more than one support means and associated covers mounted one above the other.

* * * * *